US011607364B2

(12) United States Patent
Lazarides et al.

(10) Patent No.: US 11,607,364 B2
(45) Date of Patent: Mar. 21, 2023

(54) STIMULATING DEVICE

(71) Applicant: Satina Medical UG, Berlin (DE)

(72) Inventors: Jim Lazarides, Doubleview (AU); Zisi Fotev, Wandlitz (DE); Jörg Pötzsch, Berlin (DE); Heiner Finken, Wandlitz (DE)

(73) Assignee: Satina Medical UG, Berlin (DE)

( * ) Notice: Subject to any disclaimer, the term of this patent is extended or adjusted under 35 U.S.C. 154(b) by 76 days.

(21) Appl. No.: 16/301,576

(22) PCT Filed: Dec. 30, 2016

(86) PCT No.: PCT/EP2016/002196

§ 371 (c)(1),
(2) Date: Nov. 14, 2018

(87) PCT Pub. No.: WO2017/198283

PCT Pub. Date: Nov. 23, 2017

(65) Prior Publication Data

US 2019/0290534 A1 Sep. 26, 2019

Related U.S. Application Data

(63) Continuation of application No. 29/572,567, filed on Jul. 28, 2016, now Pat. No. Des. 841,178.
(Continued)

(51) Int. Cl.
*A61H 11/00* (2006.01)
*A61H 23/02* (2006.01)

(52) U.S. Cl.
CPC ..... *A61H 11/00* (2013.01); *A61H 23/0263* (2013.01); *A61H 2023/0272* (2013.01);
(Continued)

(58) Field of Classification Search
CPC ..... A61H 23/00; A61H 23/02; A61H 2023/0272; A61H 11/00;
(Continued)

(56) References Cited

U.S. PATENT DOCUMENTS 3,124,125 A * 3/1964 Jones ..... A61H 23/0263 601/71
3,710,784 A 1/1973 Taylor
(Continued)

FOREIGN PATENT DOCUMENTS

CN 2214186 Y 2/1995
CN 204655463 U 5/2015
(Continued)

OTHER PUBLICATIONS

"JP16-70E310 Vibration Motor Specification", https://www.vibration-motor.com/products/cylindrical-vibrator-motors/strong-vibration-force/jp16-70e310 Jinglong Machinery, Oct. 22, 2012 (Year: 2012).*
(Continued)

*Primary Examiner* — Timothy A Stanis
*Assistant Examiner* — Matthew R Moon
(74) *Attorney, Agent, or Firm* — Hooker & Habib, P.C.

(57) ABSTRACT

The invention discloses a stimulation device comprising: a belt (10) containing at least two vibration modules (5, 7, 9), wherein each of the at least two vibration modules (5, 7, 9) comprises: a pod (4) with a casing (6, 26) and a vibration pad (24) arranged within the casing (6, 26), and a vibration motor (20) with a flywheel (28) within the housing (6, 26), a control panel (15) operating said vibration motors (20) of the at least two vibration modules (5, 7, 9); wherein the vibration motors (20) are mounted to the vibration pad (24) via at least one elastic motor housing (22). The invention further discloses the use of such a device for treating hypoventilation and respiratory depression and a method of
(Continued)

treating hypoventilation and respiratory depression by fastening a belt (10) to the abdomen of a user and operating the belt (10), wherein the at least two vibration modules are externally applied to an abdominal region of a user to stimulate the diaphragm, to enhance pulmonary function.

21 Claims, 6 Drawing Sheets

Related U.S. Application Data

(60) Provisional application No. 62/336,952, filed on May 16, 2016.

(52) U.S. Cl.
CPC ..... *A61H 2201/0119* (2013.01); *A61H 2201/0165* (2013.01); *A61H 2201/165* (2013.01); *A61H 2201/1628* (2013.01); *A61H 2201/5002* (2013.01)

(58) Field of Classification Search
CPC .... A61H 2201/0119; A61H 2201/0165; A61H 2201/1628; A61H 2201/165; A61H 2201/5002; A61H 11/02; A61H 2205/083; A61M 21/02; A61M 2021/0022
See application file for complete search history.

(56) References Cited

U.S. PATENT DOCUMENTS

| | | | | | |
|---|---|---|---|---|---|
| 5,277,194 | A * | 1/1994 | Hosterman | A61B 5/1135 | 600/534 |
| 5,327,886 | A * | 7/1994 | Chiu | A61F 7/007 | 601/15 |
| 5,334,131 | A * | 8/1994 | Omandam | A61H 23/0263 | 601/70 |
| 5,545,125 | A | 8/1996 | Tseng | | |
| 6,355,007 | B1 * | 3/2002 | Zuckerbrod | A61H 23/0263 | 132/73.6 |
| 2005/0023427 | A1 * | 2/2005 | Chen | G08B 6/00 | 248/346.03 |
| 2005/0059909 | A1 * | 3/2005 | Burgess | A61H 11/00 | 601/79 |
| 2006/0089575 | A1 * | 4/2006 | DeVlieger | A61H 23/0263 | 601/70 |
| 2008/0058686 | A1 | 3/2008 | Giguere | | |
| 2008/0094226 | A1 * | 4/2008 | O'Shea | A61B 5/1116 | 340/573.1 |
| 2012/0253236 | A1 * | 10/2012 | Snow | A61N 5/0618 | 601/2 |
| 2012/0323149 | A1 | 12/2012 | Chou | | |
| 2014/0316311 | A1 | 10/2014 | Nauman et al. | | |
| 2017/0291007 | A1 * | 10/2017 | Dubey | A61H 23/02 | |
| 2017/0296429 | A1 * | 10/2017 | Mayo | A61H 23/02 | |

FOREIGN PATENT DOCUMENTS

| | | | | |
|---|---|---|---|---|
| DE | 102007018647 | A1 * | 10/2008 | A61H 23/0263 |
| JP | 614752 | Y | 4/1994 | |
| KR | 100258733 | B1 * | 6/2000 | |
| KR | 2003383970000 | | 1/2004 | |
| KR | 2003533470000 | | 6/2004 | |
| KR | 1020187036603 | A | 1/2019 | |
| WO | 2006110545 | A2 | 10/2006 | |
| WO | 2006127374 | A1 | 11/2006 | |
| WO | 2012009862 | A1 | 1/2012 | |
| WO | WO-2015109397 | A1 * | 7/2015 | A61F 7/0241 |
| WO | WO2017198283 | A1 | 11/2017 | |

OTHER PUBLICATIONS

English language translation of Office Action dated Jun. 3, 2020 in corresponding China Patent Application No. 201680085824, 12 pages.
European Patent Office, Machine language English translation of the specification of CN2214186Y, 5 pages.
European Patent Office, Machine language English translation of the claims of CN2214186Y, 2 pages.
European Patent Office, Machine language English translation of the specification of CN204655463U, 4 pages.
European Patent Office, Machine language English translation of the claims of CN204655463U, 2 pages.
Office Action dated Apr. 9, 2020 in corresponding Australian Patent Application No. 2016407377, 3 pages.
European Patent Office, International Search Report, PCT/EP2016/002196, dated Mar. 28, 2017, 6 pages.
Japanese Patent Office, Office Action, Japanese Patent Application No. 2018-561034, dated Nov. 25, 2020, 3 pages.
English translation of Japanese Office Action, 4 pages.
European Patent Office, Examination Report, European Patent Application No. 16820169.7, dated Jan. 12, 2021, 4 pages.
Singapore Patent Office, Invitation to Respond to Written Opinion, Singapore Patent Application No. 11201809365T, dated Nov. 25, 2020, 7 pages.
Korean Patent Office, Office Action dated Jun. 18, 2021, 6 pages.
Computer generated English language translation of JP0614752, downloaded from https://www.j-platpat.inpit.go.jp/p0200 accessed Aug. 25, 2021, 6 pages.
Computer generated English language translation of JP036066A, downloaded from https://worldwide.espacenet.com/patent/search/family/016368233/publication/JPH0360668A?q=pn%3DJPH0360668A accessed Aug. 25, 2021, 5 pages.
Nandakumar et al., Contactless Sleep Apnea Detection, May 2015, The 13th Annual International Conference on Mobile Systems, Applications and Services (MobiSys'15) , May 2015. 13 pages, Florence, Italy, and available for download at: https://apnea.cs.washington.edu/apneaapp.pdf.

* cited by examiner

STIMULATING DEVICE

FIELD OF THE INVENTION

The invention relates to a stimulating device, particularly for stimulating the diaphragm, the use of such a device and methods of treating hypoventilation and respiratory depression. More particularly, the present invention relates to a device for stimulating the diaphragm to enhance pulmonary function, particularly by biomechanical muscle stimulation. A belt is provided containing at least two vibration modules, which are externally applied to an abdominal region of a user to stimulate the diaphragm.

BACKGROUND

It is known that biomechanical muscle stimulation in various diseases leads to the improvement of the condition of the patient. The main application of biomechanical muscle stimulation is in the medical field, in sports and in cosmetics. In particular, in the medical field it has been found that a rapid and sustained improvement of physical mobility can be achieved using biomechanical stimulation for specific diseases, in particular for chronic pain, certain types of periphery paralysis, arterial and peripheral circulatory disorders, muscle metabolism disorders, muscle atrophy, muscle dystrophy and in various forms of arthritis.

DE 10 2004 009 452 B4 for example, discloses a device for stimulation of the heart muscle, which particularly promotes the conservation of the type IIa muscle fibers. Here, the device comprises a pulse generator unit for generating and sending out an electrical stimulation pulse. The unit can be controlled by a control unit. A disadvantage of the device is that it is acting solely on the heart muscle and thus its use is restricted. The hardware of the device is solely restricted to the specific application.

Furthermore, DE 102 41 340 B4 describes a complex device for biomechanical muscle stimulation for use in rehabilitation, regeneration. A horizontal tread plate is fixed to a vibration unit, where the tread plate swings horizontally with an amplitude of preferably 4 to 5 mm. The user by means of handles, straps or ropes achieves the desired body tension. A disadvantage of the disclosed apparatus is that the vibrations or oscillations affect the whole body and cannot be applied locally to specific muscles or groups of muscles. Furthermore, the device is very large and cannot be used on the move. The stimulation of the muscles is exclusively achieved by active work performed by the user, which is not always possible to do. The device may be difficult or impossible to be used by the elderly.

DE 201 16 277 U1 discloses a device for biomechanical stimulation, with the aid of which a massage therapist can induce vibrations directly on certain areas of the body of a patient. The device comprises a vibration generator with a mechanical drive unit for the generation of oscillatory motions. The device is very large and heavy and cannot be used on the move. In addition, it is required to be operated by a trained professional.

Conditions relating to chronic lung disease and respiratory depression are staggering in the developed and developing nations alike. As an example, in the U.S. alone Chronic Obstructive Pulmonary Disease (COPD) is the third leading cause of death with over 11 million individuals diagnosed with the condition. Conditions like asthma affect over 17 million in the U.S., including 5 million children. Examples of lung depression include sleep apnea, opioid use, pneumonia, interstitial lung disease, sleep apnea, congestive heart failure and psychogenic causes such as anxiety or PTSD. All of these conditions have varying pharmaceutical interventions providing varying effectiveness, with accompanying side effects.

Attempts have been made to remedy respiratory depression to relieve ailments such as COPD, sleep apnea and respiratory depression of various origin by external stimulation, however these attempts have not been ideal, successful or convenient to a user.

For instance, DE 298 12 986 U1 discloses a respiratory stimulation device combining an alternating magnetic field effect with mechanical vibration for mechanical stimulation of abdominal and flank breathing. The device consists of a belt with four electrically driven motors and associated mechanical eccentrics. The motor is placed directly into a bulged plastic casing that generates vibrations in all directions and thus the whole unit vibrates Hence, vibrations cannot be controlled and there is no damping of the vibrations in any direction. A disadvantage of the devices described in the prior art is that the muscular stimulation is associated with not inconsiderable pain and the user must remain in a particular body position. In addition, electrostimulation is applied, which can induce pain and needs to be in direct contact with skin. No data has demonstrated effectiveness, and it is questionable whether it is functional due to the complicated motor-magnet construction.

DE 202010018159 U1 discloses a respiratory stimulation belt comprising an integrated sensor unit and at least two vibration generators integrated a housing and in a tubular flexible structure. Due to the insertion of the housing of the vibration generators in the belt the vibration generators generate vibrations in all directions and cannot be controlled. The vibrations have a frequency of 6 to 12 Hz. There is no indication of frequency, amplitude or time required before effects, if any, are observed.

DE 10 2010 022 603 A1 discloses a respiratory stimulation belt wherein a flywheel is magnetized or magnetized elements are incorporated into the flywheel to enhance a magnetic field generated by the motor and magnetic elements. The flywheel is magnetized by a disc magnet, part magnetic or bar magnet and the magneto-mechanical vibrations cause their effects via magnetic waves. Further, the magneto-mechanic vibration unit can be combined with an inductive transformation element causing electrical stimulation currents to muscles.

WO 01/19316 A2 discloses a digitally controlled vibratory therapy apparatus comprising one electromechanical vibrator and digital control means for employing cycloid vibrations. The digital control means utilizes linear time integrated frequency control and a small amplitude vibration without being further specific.

SUMMARY OF THE INVENTION

Generally, as people age, their respiratory muscles weaken (the diaphragm muscle in particular), the lungs become more stiff and less elastic, cardiorespiratory capacity is reduced as well as mobility, making daily activity difficult and also reducing sleep quality. By 75 years of age, the vital capacity of the lungs is 50% less than younger persons. In other words, as people age, the lungs are functioning less efficiently and the amount of vital oxygen that is inhaled is reduced, which is essential for our brains, heart and other organs to function optimally. Also as people age, the correct breathing pattern deteriorates to the shallow, rapid chest breathing method, which has the negative effect of using more energy and activating stress within the body, as well as causing people to inhale less air or oxygen. This causes the wide experienced effects seen by many older persons such as anxiety, poor sleep, lack of mobility and, even depression. The stress aspect will also be targeted towards additional age groups that suffer high stress or anxiety, as well as those having sleeping problems.

The present invention has the object to provide for an improved stimulation device, particularly for stimulating the diaphragm, the use of such a device and an improved method of treating hypoventilation and respiratory depression.

The stimulation device according to the invention comprises: a belt containing at least two vibration modules, wherein each of the at least two vibration modules comprises: a pod with a casing and a vibration pad arranged within the casing, and a vibration motor with a flywheel within the housing, a control panel operating said vibration motors of the at least two vibration modules; wherein the vibration motors are mounted to the vibration pad via at least one elastic motor housing.

The invention also comprises the use of a such device for treating hypoventilation and respiratory depression and a method of treating hypoventilation and respiratory depression by fastening the belt to the abdomen of a user and operating the belt, wherein the at least two vibration modules are externally applied to an abdominal region of a user to stimulate the diaphragm, to enhance pulmonary function.

The elastic motor housing of the stimulation device provides for elastic support of the vibration motor relative to the belt and housing of the motor such that generated vibrations are mainly directed to the user and thus the energy impacting a user is used more efficiently compared to the devices known from the state of the art. With the directed vibrations due to elastic mount/suspension the vibration pad vibrates and the impulse has more degrees of freedom and provides for a better impact on diaphragm. The device and the method of the present invention enhance pulmonary function by stimulating the diaphragm.

The present invention alleviates symptoms related to hypoventilation and shallow breathing from various causes of lung disease and respiratory depression by averting pharmaceutical intervention and delivering relatively immediate results in enhancing and optimizing breathing ability. This results in increased blood oxygen levels, reduced heart and breathing rates and improved quality of life. The present invention is easy to use, overcomes the difficulties of use of the prior art, and has no observed negative side effects. The device of the present invention is more efficient than the prior art, i.e., within 2 mins the diaphragm is activated, and effects on 100% of individuals tested have been observed.

The device and method according to the present invention can stimulate the diaphragm to enhance pulmonary function, and subsequently the parasympathetic nervous system to enhance relaxation, reduce the heart and breathing rates and improve sleep quality and even pain. For example, a program of the device may be used for falling asleep, where the number of revolutions of the motor is reduced. This however can even increase the positive effects on the user. The device contains a belt with at least two removable engaged vibration modules, which are provided to make contact with a user to engage the diaphragm of a user Generally, the device of the present invention applies a biomechanical vibration to the human body through the contact of the vibration modules via the pods and vibration pads with the human body. The belt according to the present invention consists of at least two vibration modules, each housing a vibrating motor. The vibration modules are engaged with a strap, creating a belt, for contacting the abdomen of a user to stimulate the diaphragm. The motors are controlled by an electronic circuit. The electronic circuit is controlled by a control panel, which may be powered by a battery that is optionally rechargeable. The control panel controls the voltage and time that the motors run for.

The belt may be worn by a user any time during the day or night. The belt of the present invention may be worn only for the amount of time that the user wishes for the diaphragm to be stimulated, or it may be worn for an extended period of time and the vibration motors activated intermittently throughout the extended period of time. The belt of the present invention may be used in any position by a user, for instance sitting, standing, or in a supine position. The belt may be worn and used while working in an office, sitting at a computer or when engaging in manual labor. The vibrations "train" the diaphragm so that its ability to function or contract on its own increases and after the use in morning or evening should keep working for several hours. Minimum use time is 10 min and upto 30-60 min. Moreover, the diaphragm recognizes the vibrations increasingly faster with repeated use that it commences to work quicker with each use of the belt.

In an embodiment of the invention the belt comprises three vibrating modules that are arranged equidistant or in varying distance to allow for an optimal stimulation effect of the diaphragm for deep breathing movement of the stomach, i.e. the pods and vibration pads with the motors continue to vibrate optimally during the "expansion" phase during inhalation.

In an embodiment of the present invention each of the vibration motors of the device is spaced away from the vibration pad via the motor housing. This measure ensures a free movement of the flywheel attached to the motor within the housing or casing.

In an embodiment of the present invention in the device the motor housing is mounted to the vibration pad via a snap-fit connection. This measure provides for a secure coupling of the motor and the motor housing. Alternatively, suitable attachment means may be used and or additional attachment means, e.g. adhesives or mechanical couplings.

In an embodiment in the device of the present invention each of the motor housings is at least partly designed in a complementary manner to the vibration motor for holding and supporting the vibration motor. This measure provides for an easy assembly of the device and a secure support of the motor within the motor housing.

In an embodiment of the present invention the belt of the device comprises a strap having at least one a belt fastening attachment. The belt may be flexible. This measure provides for an easy adjustment of the belt to the user, specifically to the abdomen of the user. The belt fastening attachment may be of any suitable fastening means.

In an embodiment of the present invention the casing comprises a main casing and a back casing wherein the vibration pad is arranged within the back casing and/or the main casing is provided with a front panel. With this measure the vibrations are directed to a user more efficiently. Specifically with an elastic vibration pad and the elastic motor housing the vibrations impacting on the casing are dampened and the vibration pad is supported resiliently with respect to the casing.

In an embodiment of the present invention the main casing and/or the back casing of the device comprise at least one attachment means for engagement with and through the strap and engagement with the other of the back casing or main casing. This measure provides for a suitable and safe connection between casing and strap and ensures that the vibration pads are kept in position.

In an embodiment of the present invention the control panel operates said vibration motors with an amplitude from around 0.3 G to 1.0 G and frequency ranging from 16 Hz to 45 Hz complementary to a voltage 0.6V to 1.3V. Preferably the control panel operates said vibration motors with an amplitude of around 0.4 G at a frequency of 30 Hz (0.8V) to an amplitude of 0.62 G at a frequency 37 Hz (1.0V). The exact optimal frequency and amplitude is also person dependent, i.e. weight, age and general sensitivity. With these operation conditions optimal effects are achieved and quantified as clear changes in breathing pattern to deep, slow rhythmic diaphragm breathing and quantified as reduction in breathing rate of 20% or more.

In an embodiment of the present invention the belt is flexible and/or adjustable to a wearer's anatomy. Hence, the length of the belt can easily be adapted to the users and one belt can be adapted to different users.

In an embodiment of the present invention the at least one of the flywheels is dimensioned of around 12 mm diameter and 8 mm thickness. This measure provides for efficient vibrations.

In an embodiment of the present invention the at least one of the flywheels has a weight of 7-8 grams and/or is spaced 1-5 mm from the end of the motor. This measures my even more improve the efficiency of the device and the impact of the vibrating impulses. This weight and arrangement is based on several test results (compare below).

In an embodiment of the present invention the device may further comprise a display for displaying and monitoring vital functions, wherein the display of vital functions is integrated via an interface and/or the interface supports the exchange of information with an external device. This measure can improve the functionality of the device.

In a further embodiment the invention provides for a method of treating respiratory depression by engaging a belt device to the abdomen of a user, the belt device comprising: a) a strap having a belt fastening attachment; b.) at least two vibration motors engaged with said strap; c) said motor comprising a flywheel of 12 mm diameter, 8 mm thickness and 7-8 grams; d) a control panel operating said at least two vibration motors; wherein said vibration motors have amplitude from 0.3 G to 1.0 G and frequency ranging from 16 Hz to 45 Hz. In an embodiment the at least two vibration modules are externally applied to an abdominal region of a user to stimulate the diaphragm, to enhance pulmonary function.

In an embodiment, the device of the present invention contains a belt, wherein the belt is adjustable in size to accommodate for variations in the size of a user. The belt contains at least two removable vibration modules, each module containing a vibration motor controlled by a control panel device. The belt of the present invention is provided to contact the abdominal region of a user under the rib cage to stimulate the diaphragm.

The vibrating motor of the present invention may be effective at varying voltage, amplitude and frequency. An approximate effective range of the amplitude is from about 0.3 G to about 1.0 G, or a voltage from about 0.6V to 1.3V. An approximate effective range of the frequency is from about 16 Hz to about 45 Hz.

In an embodiment of the invention, the device can be used to deepen abdominal or flank breathing. Abdominal breathing, also called diaphragmatic breathing, is a normal, easy breathing form. The diaphragm is the main breathing muscle and is located between the chest and the abdominal cavities. Abdominal breathing occurs by a contraction of the diaphragm, whereby the negative pressure in the pleural space is growing. Following this negative pressure, the lung extends and air gets sucked in. Exhalation in this breathing technique occurs by relaxation of the diaphragm, whereby the lung due to its own elastic properties contracts and pushes the air out. Consciously, exhalation can be supported by contracting the abdominal muscles.

The device may be used for increasing the activity of the diaphragm. With the contribution of mechanical vibrations, the muscle of the diaphragm gets stimulated and subsequently can contribute to a better expansion of the lungs. A further benefit of using the device of the present invention is the activation of the parasympathetic nervous system, which subsequently reduces heart and breathing rates, increases muscle relaxation, relieves tension, pain in lower torso, abdominal contractions and improves sleep quality. In addition, the use of the device of the present invention helps with sleeping disorders such as insomnia. Yet another benefit of the device of the present invention is the assistance in weaning an individual from the use of mechanical ventilation.

DETAILED DESCRIPTION OF THE INVENTION

Figure 1:
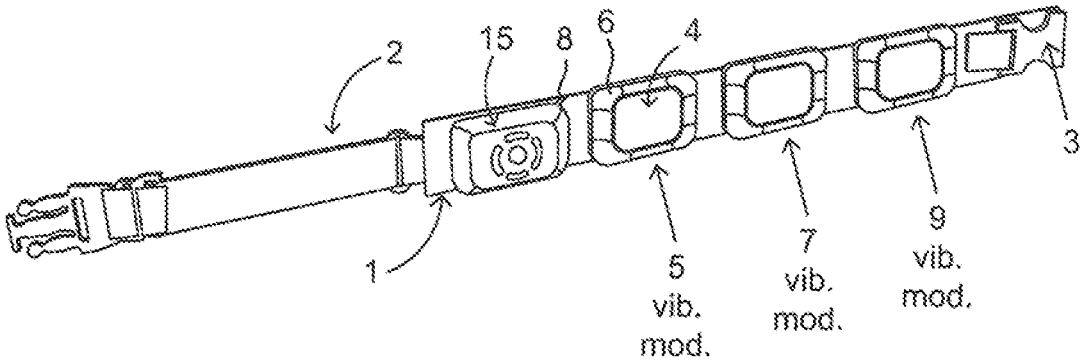
FIG. 1 illustrates a front view of an adjustable belt, in a linear open position, having at least two vibration modules and associated control panel.

While the present disclosure may be susceptible to embodiments in different forms, the drawings show, and herein will be described in detail, embodiments with the understanding that the present description is to be considered an exemplification of the principles of the disclosure and is not intended to be exhaustive or to limit the disclosure to the details of construction and the arrangements of the components set forth in the following description or illustrated in the drawings.

Generally, the device of the present invention applies a mechanical vibration to the human body through the contact of vibration pads of a respective pod comprising vibration motors. The present invention consists of at least two vibration modules, each housing a vibrating motor. The vibration modules are engaged with a strap, creating a belt, for contacting the abdomen of a user to stimulate the diaphragm. The motors are controlled by an electronic circuit. The electronic circuit is controlled by a control panel, which may be powered by a battery that is optionally rechargeable. The control panel controls the voltage and time that the motors run for. The belt may be worn by a user any time during the day or night. The belt of the present invention may be worn only for the amount of time that the user wishes for the diaphragm to be stimulated, or it may be worn for an extended period of time and the vibration motors activated intermittently throughout the extended period of time. The belt of the present invention may be used in any position by a user, for instance sitting, standing, or in a supine position. The belt may be worn while working in an office, sitting at a computer or when engaging in manual labor.

FIG. 1 illustrates the front view of a length-adjustable belt 10 of the present invention in an open position, comprising three vibration modules. More particularly, the belt 10 comprises a first vibration module 5, a second vibration module 7 and a third vibration module 9. Each vibration module comprises a casing 6 and a pod 4 containing a vibration motor. The belt 10, further depicts a strap 1 between the vibration modules 5, 7 and 9. Further, a control panel 15 is mounted to the strap 1 in any suitable manner, for example via clamp 8. The vibration modules 5, 7 and 9 are mounted to the strap 1 of the belt 10 equidistantly. When attached to a human being this arrangement allows for the optimal stimulation effect of the diaphragm for deep breathing movement of the stomach, i.e., the belt 10, i.e. vibration pads of the vibration modules 5, 7 and 9 (pods 4) with the motors continue to vibrate optimally during the "expansion" phase during inhalation.

The strap 1 of belt 10 may be constructed of a variety of suitable materials, including lycra, any material containing spandex, neoprene, elastic, cotton, nylon webbing, StretchBands™, silicone, ethylene propylene diene monomer (M-class) rubber, urethane, Chloroprene, Hypalon, natural rubber, leather, cloth, plastics and the like. In an embodiment, the strap 1 is stretchable and made of materials such as including lycra, any material containing spandex, neoprene, elastic, nylon webbing, StretchBands™, silicone, ethylene propylene diene monomer (M-class) rubber, urethane, Chloroprene, Hypalon or natural rubber. In yet another embodiment, strap 1 is made of a combination of neoprene, elastic and nylon webbing. Strap 1 may be of varying lengths and widths suitable for the size of the respective user. Strap 1 may be constructed of an inner strap, closest to the abdomen of a user, and an outer strap away from a user. Between the inner strap and outer strap are a path of the wires leading from a control panel to the motors. Alternatively, the path of the wires may be integrated in the strap.

Belt 10 further comprises a belt fastening attachment 2, 3 for closure around a user. The belt fastening attachment 2, 3 may be selected from a variety of off the shelf buckles such as quick-release clips, simple buckles, adjuster buckles, belt buckles and the like. In other embodiments, the belt securing attachment 2, 3 may comprise snaps, clips, zippers, buttons, clasps, clips, knots, ties, Velcro, pins, hooks or any other fastening means known in the art.

Vibration modules 5, 7 and 9 each contain a removable pod 4, which contains a vibration motor. Pod 4 is advantageously removable for repair or exchange of the pod or vibration motor. In an embodiment, the motor sits in a plastic housing that clicks into place, and the outer casing of the removable pod(s) 4 is screwed over the complete casing 6. The pod can also be glued to casing 6. Said pod 4 may be made by injection moulding of materials such as plastic, metal, silicone, synthetic fabric and the like. The dimension of the pod may vary. Smaller pods may be used for smaller belts and larger pods may be used for larger belts. In an embodiment, the pods may be about 6-8 cm in width; about 8-9 cm in Length; and about 2.5-3.5 cm in depth depending on the size of the motor to be housed.

Figure 2:
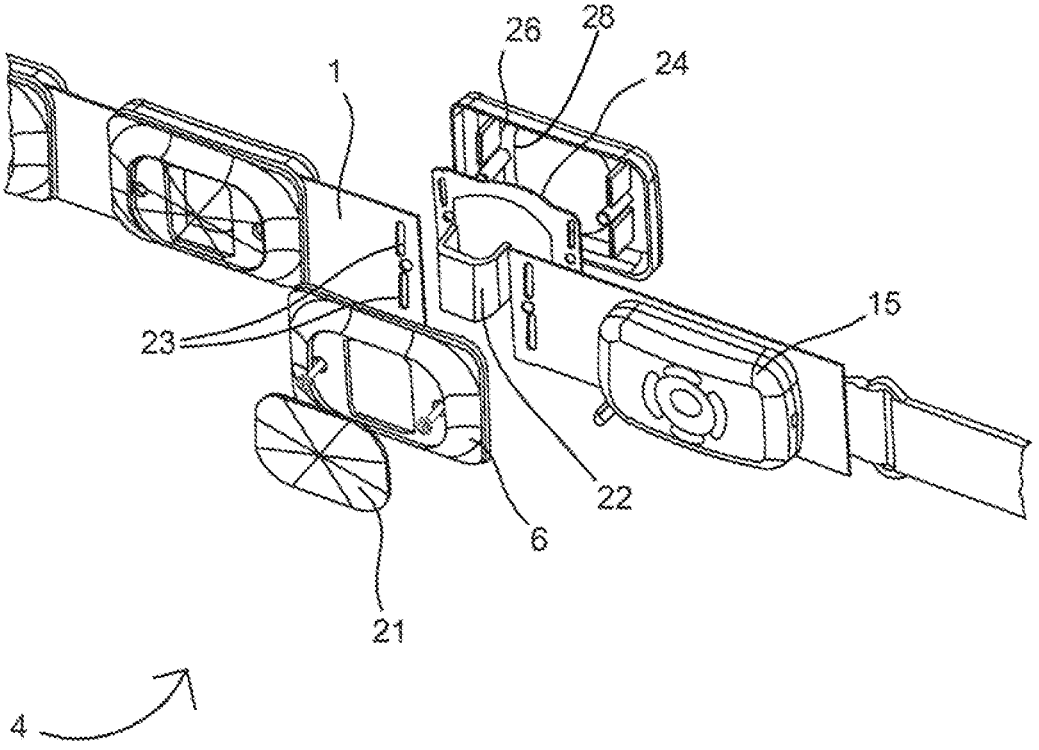
FIG. 2 illustrates an exploded view of a pod component of a vibration module.
Figure 8A:
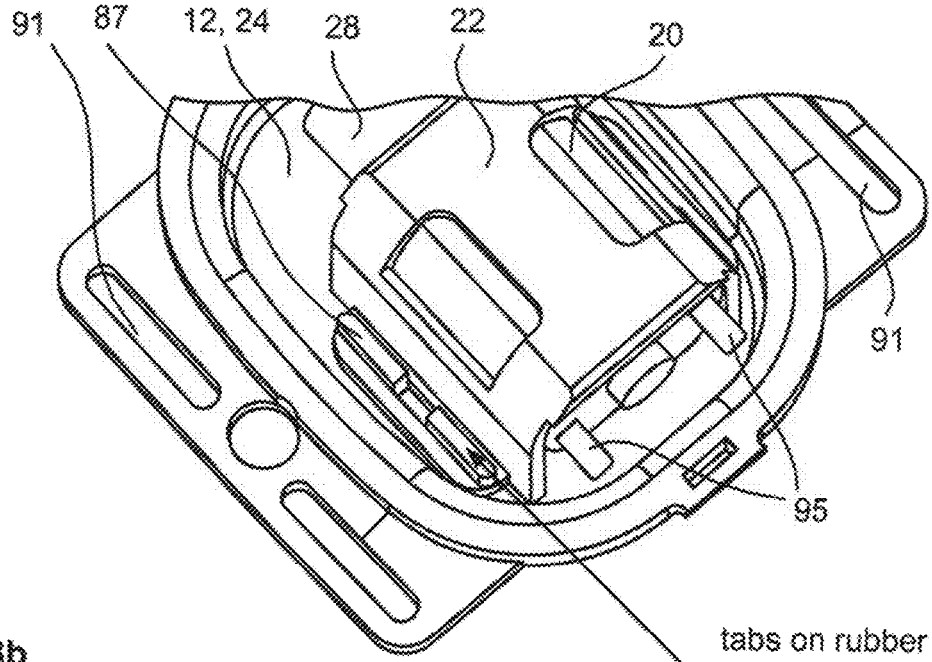
FIG. 8*a* illustrates a back perspective view of a vibration module.

Relating to FIG. 2, the exploded view of pod 4 illustrates a front panel 21, which covers the pod. The front panel 21 may be made of ABS plastic and made by injection molding. The front panel 21 may be made of any metal or other suitable material. The front panel 21 may be of any color and may be imprinted or embossed with a logo or design. The casing forms a structural cabinet feature that clamps the strap into position and guides the wiring. The belt has slits 23 for engaging the casing 6 to secure to the belt. The casing 6, may also be made by injection molding of ABS plastic. The casing 6 may also be made of metal or any other suitable material. The pod 4 also comprises a back casing 26 with a motor housing 22. The motor housing 22 receives and houses a vibration motor 20 and is mounted to a vibration pad 24. The motor housing 22 isolates the motor from main casing 6. In an embodiment, the motor housing 22 may be made of ABS plastic by injection moulding, or may be made of any other suitable material. In an embodiment each of the motor housings 22 is made of an elastic material, e.g. silicone. The motor housings 22 are designed at least partly complementary to the outer surface of the motor (comp. FIGS. 4 and 8*a, b*) to receive and hold the motor 20 when the pod 4 is mounted or assembled. The vibration pad 24 is used to transmit the vibrations from the motor to the user's body. The vibration pad 24 incorporates damping features, such as a sponge, and isolates the vibration motor from main casing 6. The vibration pad may be made of a silicone, i.e. Rubber, TPE/TPU or PVC or any other suitable material. The back casing 26 forms a structural cabinet to clamp the strap in position via slits 23 of strap 1 and to guide wires. For this purpose the back casing 26 comprises two extensions that extend perpendicularly to the back casing 26 for engagement with slits 23 of strap 1. The back casing 26 also includes a through-opening 28 that is overlaid and covered by the elastic vibration pad 24. The opening 28 enables a portion of the vibration pad 24 to protrude through the through-opening 28 to outside of the back casing 26 (note the protrusion of the vibration pads 12, 14, 16 from the pods in FIG. 3) and come directly into contact with the wearer to transmit vibrations generated by the motor 20 to the wearer. The casing 6 comprises pins or other suitable means also extending perpendicularly to the casing 6 for counter engagement with the extensions to hold the vibration modules 5, 7 or 9 or pod 4 securely on the strap 1 in position. The back casing 26 may be made by injection moulding of ABS plastic, or may be made of metal or any other suitable material.

Figure 3:
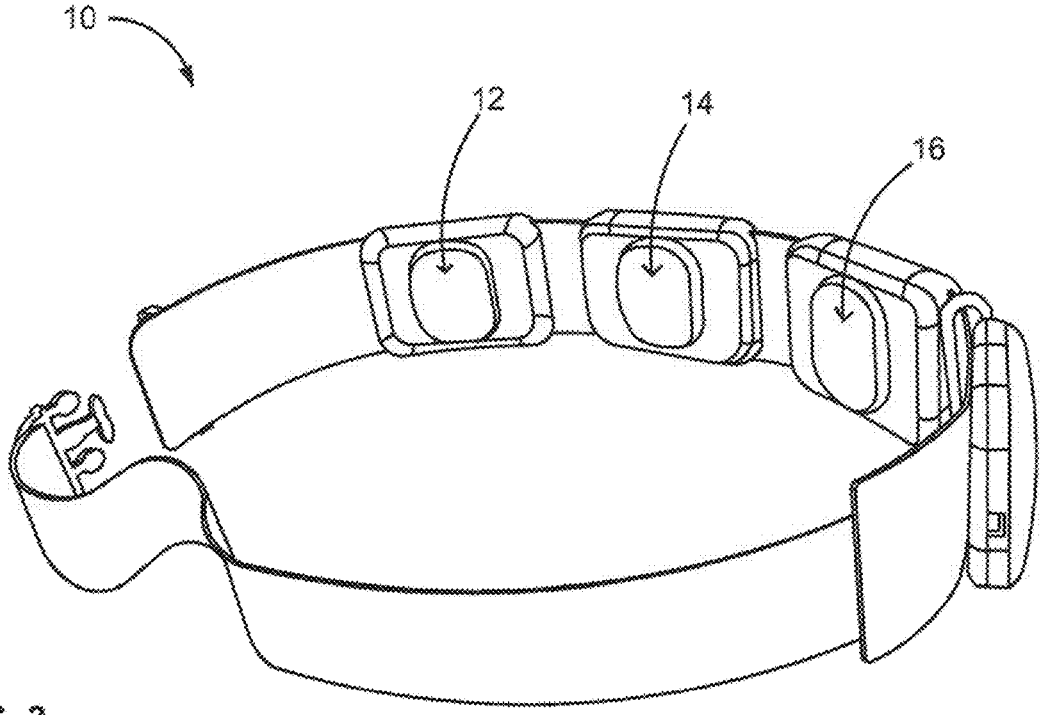
FIG. 3 illustrates a view of the user contact side of a belt having at least two vibration modules and associated control panel.
Figure 4:
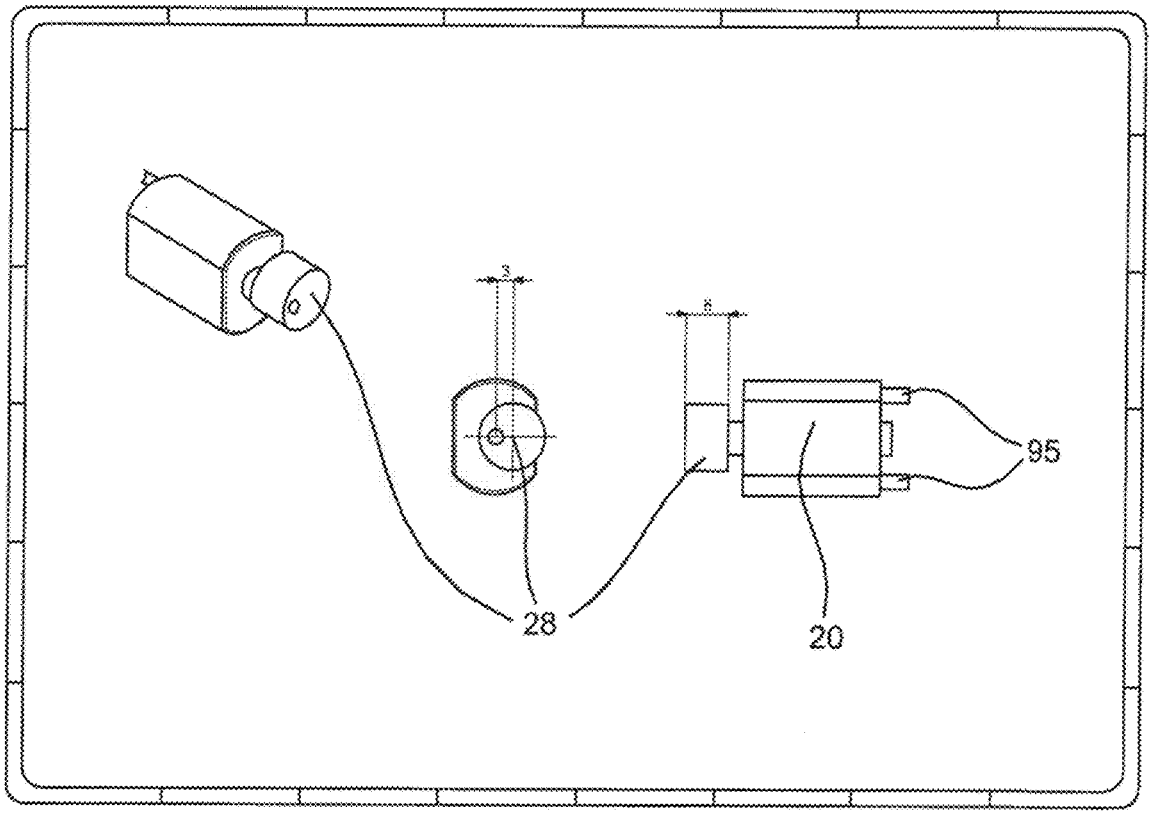
FIG. 4 illustrates a vibration motor.

FIG. 3 illustrates the posterior side of the casing 6 and the user contact side of the pod 4, whereby contact is made by vibration pads 12, 14 and 16 (24 in FIG. 2). The vibration pads 12, 14 and 16 (24) provide beneficial features, such as transmitting the vibration effects in a more focused and efficient manner than plastic casing due to the elastic support or mount of the motor 20 within the elastic motor housing 22. The elastic support of the motor 20 with respect to the casing 6 and back casing 26 allows for directing most of the generated vibrations to the user increasing the efficiency of the stimulation device. The silicone vibration pad is also quieter than plastic casing construction and more comfortable for a user.

Vibration motors used in the present invention may be off the shelf and equivalent to Precision Microdrives™, Model 320-100, Uni-Vibe™, 20 mm Vibration Motor-25 mm Type. A variety of motors may be used, as generally illustrated in FIG. 4. The vibration motor may generally include motor casing, washers, a NdFeB neodymium permanent magnet, a motor shaft, a motor end cap, ball race bearings and an eccentric mass counter weight (the flywheel 28). Larger or smaller motors may be used in the present invention, but what is critical is that the frequency or amplitude or voltage range is achieved with any type of motor for the effect to be seen. It has been noted with larger motors, a user may experience discomfort, pain or abrasions. However, in the present invention, variations in performance were noted when similar motors were tested with variations of size and weight of the flywheel. The flywheel should be spaced 1-5 mm from the end of the motor in a preferred embodiment.

Surprising results were seen related to a small change in the flywheel size/dimension and weight, which had a significant effect on stimulating the diaphragm in an effective manner. In addition, an optimal range of the frequency-amplitude was determined, outside of which effectiveness in stimulating the diaphragm significantly decreases. Therefore, the frequency-amplitude relationship is very critical to cause activation of the diaphragm. Activation of the diaphragm can be measured as a change in breathing pattern, i.e., shallow breathing versus slower deep belly breathing. This can be quantified by slower breathing (rate/min) and also heart rate.

The flywheel was of 12 mm diameter, 8 mm thickness and 7-8 g. The motor is Precision Microdrives™, Model 320-100.

Table:

Effects on diaphragm quantified as below:

+++ is strong activation of deep belly (diaphragm) breathing; the breathing rate is deeper and slower as measured by breaths per minute (reduction greater than 20% of normal previous breathing)

+ is only slight effect on diaphragm breathing i.e., a 10% or less reduction of breathing rate – No effect on diaphragm activation or breathing rate

| Voltage | Amplitude | Frequency | Effect on diaphragm |
|---|---|---|---|
| 1.2 V | 0.95 G | 43 Hz | +++ |
| 1.0 V | 0.62 G | 37 Hz | +++ |
| 0.8 V | 0.4 G | 30 Hz | +++ |

Precision Microdrives™, Model 2 (320-105 standard). This has exactly the same motor as above, but different flywheel (18 mm diameter×6 mm thickness, but is only a half circle, i.e., not complete).

| Voltage | Amplitude | Frequency | Effect |
|---|---|---|---|
| 1.2 V | 1.0 G | 45 Hz | – |
| 1.0 V | 0.8 G | 35 Hz | + |
| 0.8 V | 0.5 G | 28 Hz | + |

Model 3. Same motor but flywheel slightly different (10 mm diameter, 3.5 mm thickness)

| Voltage | Amplitude | Frequency | Effect |
|---|---|---|---|
| 1.2 V | 0.8 G | 55 Hz | – |
| 1.0 V | 0.54 G | 45 Hz | – |
| 0.8 V | 0.34 G | 37 Hz | – |

Effects on lung function were notable within the range from 0.3 G at 20 Hz to 1.00 at 45 Hz. Optimal effects were observed in the range from 0.8V (30 Hz at 0.4 G) to 1.0V (37 Hz at 0.62 G). Optimal effects are quantified as clear changes in breathing pattern to deep, slow rhythmic diaphragm breathing and quantified as reduction in breathing rate of 20% or more. The amplitude was measured using a closed-loop control (accelerometer) and accurate motor speed measurement device. An MMA 7361 triple axis accelerometer from Freescale was used and mounted on a PCB with several external components. The vibration motor and accelerometer were mounted together. These were then mounted with a 100 g mass (sled). This target mass has a direct influence on the measured vibration amplitude and helps to standardize the measurements. This was done as described by Precision Microdrives of UK.

The device of the present invention comprises a single control panel PCBA, which includes a number of TACT switches and LED's. The control panel may be used to control the speed of the motors by varying the voltage supplied to the motors. The control panel may also control the time the motors run for and have pre-programmed functions that control the time for different motor speeds. FIG. 1 additionally, illustrates a control panel 15, removably engaged with strap 1, for convenient storage via clamp 8. Control panel 15 is a handheld device, which can work independently from the power grid using a grid-independent power supply, such as a battery. Generally, the control panel 15 may be made of any suitable plastic or metal known in the art. Control panel 15 may be fixedly or removably secured to strap 1 by any means known in the art.

Figure 5:
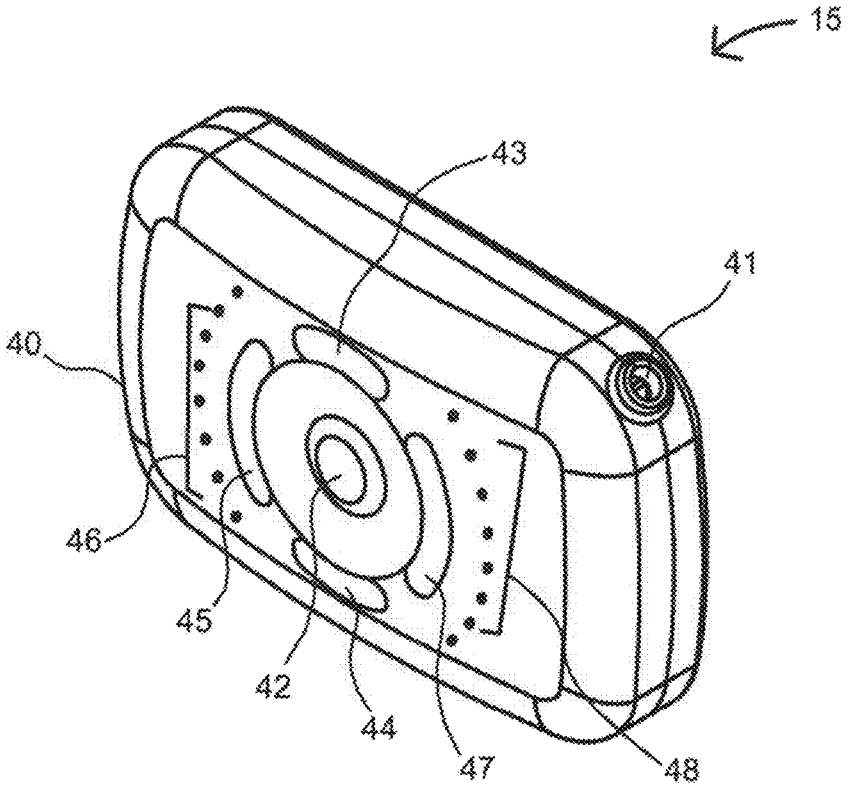
FIG. 5 illustrates a front perspective view of the control panel.

FIG. 5 illustrates a front perspective of the control panel 15, having a front control panel casing 40. Also illustrated, a wire port 41 connects a circuit board in the control panel 15 to the motors. Power control pad 42 turns the control panel 15 on or off. Program 1 control pad 43 is to select a pre-programmed schedule of voltage and time by which the vibrating motors will operate. Examples of such programs are provided below. Program 2 control pad 44 is to select an alternate pre-programmed schedule of voltage and time by which the vibrating motors will operate. Examples of such programs are provided below. A timing control pad 45 may provide a step-wise increase of the time the vibrating motor will operate. A timing button may be programmed to increase or decrease in any increment of time, such as seconds, minutes, hours and the like each time it is selected. Timing Magnitude Indicators 46 is a light feature to indicate the increase or decrease in increments of time. Speed control pad 47 is selected to increment Voltage each time it is selected. The increment in Voltage may either be an increase or decrease, the magnitude of which is indicated by the lighting on Speed Magnitude Indicators 48. Varying control features may be incorporated into a control panel for the present invention. LED readouts of which program is selected, the speed, timing and any other useful information for a user may be provided. Additional control buttons may be added, which may be specific to each motor, for instance to turn the power on an off for each motor independent of the others. Other controls and selection buttons may be added for independent control of the speed, voltage, amplitude, frequency and time of Operation of each motor independent of the others. Those skilled in the art will recognize that a variety of controls may be incorporated in the control panel to enhance the user experience for convenience and/or maximum health benefit. The buttons of the present invention may be made of any suitable material known in the art, and may include silicone and rubber.

Figure 6:
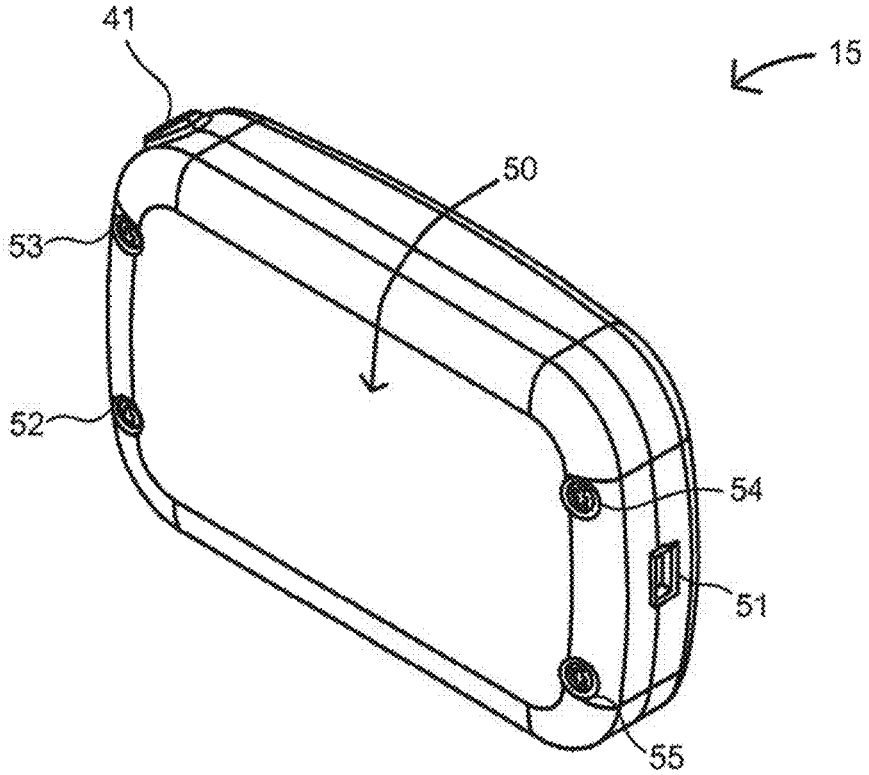
FIG. 6 illustrates a back perspective view of the control panel.

FIG. 6 illustrates a back perspective view of control panel 15, providing a back control panel casing 50 and view of charging port 51 for recharging a rechargeable battery in the control panel 15. FIG. 6 illustrates charging port 51 as a micro USB port, however any suitable charger and port used in the art may be used. FIG. 6 also indicates four screws 52, 53, 54, 55 by which the control panel is secured from the front panel to a back panel 56.

Figure 7:
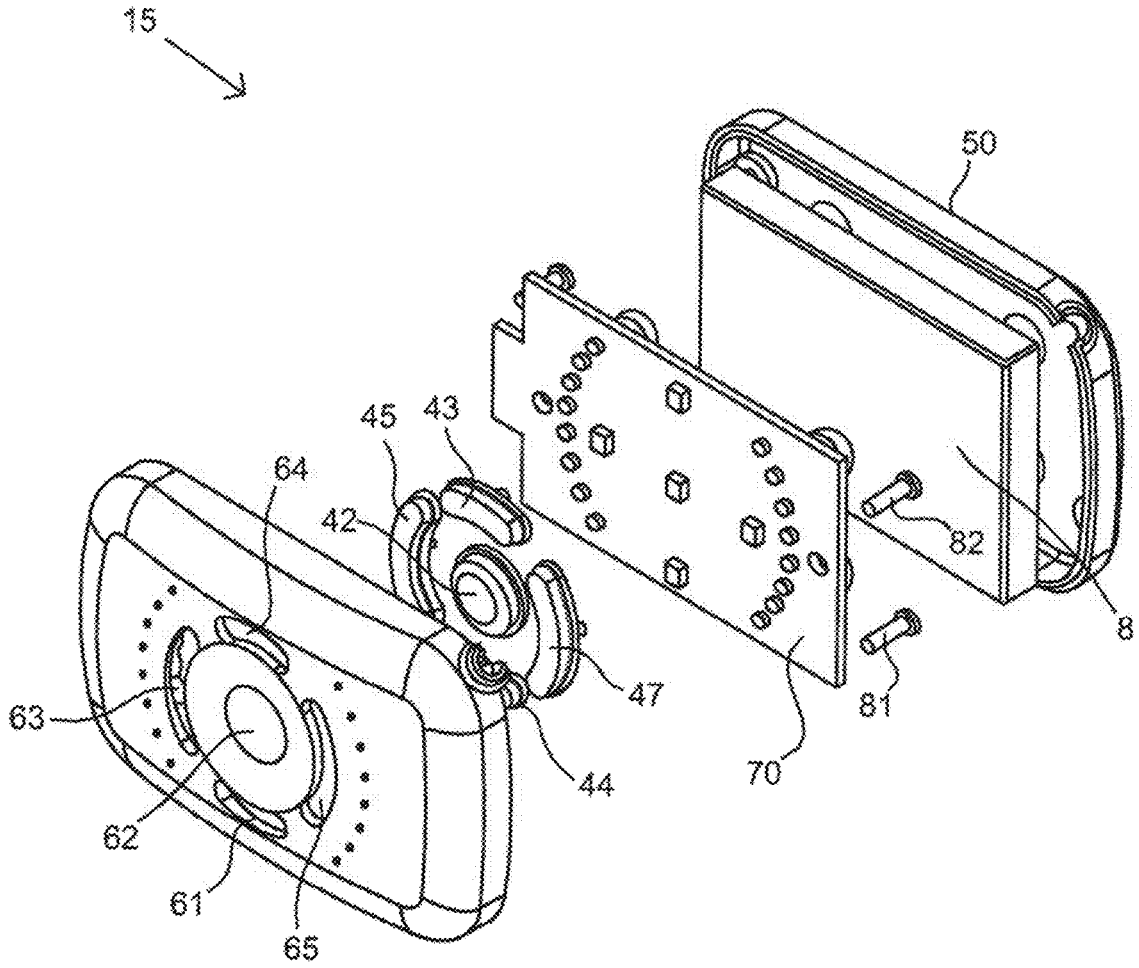
FIG. 7 illustrates an exploded view of the control panel.

FIG. 7 is an exploded view of control panel 15, having front control panel casing 40 comprising perforations 61, 62, 63, 64, 65 for receiving control pads 42, 43, 44, 45, 47 (not fully shown). Control pads 42, 43, 44, 45, 47 engage with and operate an electrical circuit board 70. Circuit board 70 is programmed with multiple programs to control the voltage, amplitude, frequency and times for which the vibrating motors will engage. Examples of such programs are below. The back of the circuit board 70, not depicted, comprises wire connections for the electrical circuit to route through the wire port 41 to the positive and negative inputs of the vibrating motors. Pegs 81, 82 are used to mount the front control panel casing 40 to the back control panel casing 50. FIG. 7 also depicts a rechargeable battery 85, encased and enclosed within the control panel 15 by the back control panel casing 50. Rechargeable battery 85 may be any of those used in the industry, including but not limited to lithium sulfur, sodium ion, thin film lithium, zinc bromide, zinc cerium, vanadium redox, sodium-sulfur, molten salt, silver-zinc, Quantum Battery or any other suitable rechargeable battery.

The control panel may be programmed with different variations in voltage and time to provide a user with varied options depending on their health needs. Programs may start the rotating motors for any length of time, but the best results have been seen with at least 10 minutes of use. Motors may be programmed to pulsate or provide intermittent stimulation of the diaphragm, of varying duration, throughout the day for a user that wears it throughout the day or night. Examples of programs selectable on the control panel are as follows:

Program 1

| Voltage | Time (min) |
|---|---|
| 1.0 V | 10 |
| 0.9 | 10 |
| 0.8 | 10 |

Program 2

| Voltage | Time (min) |
|---|---|
| 1.0 V | 5 |
| 0.9 | 10 |
| 0.8 | 15 |

Program 3

| Voltage | Time (min) |
|---|---|
| 1.2 V | 2 |
| 1.0 | 10 |
| 0.9 | 10 |
| 0.8 | 10 |

Program 4

| Voltage | Time (min) |
|---|---|
| 1.2 V | 5 |
| 1.0 | 5 |
| 0.9 | 10 |
| 0.8 | 10 |

Program 5

| Voltage | Time (min) |
|---|---|
| 0.8 | 10 |
| 0.7 | 10 |
| 0.6 | 10 |
| 0.7 | 5 |
| 0.8 | 5 |

Program 6

| Voltage | Time (min) |
|---|---|
| 0.9 | 10 |
| 0.8 | 10 |
| 0.7 | 10 |
| 0.6 | 10 |
| 0.8 | 5 |

Program 7

| Voltage | Time (min) |
|---|---|
| 1.0 | 10 |
| None | 5 |
| 1.0 | 10 |
| None | 5 |
| 0.8 | 10 |
| This cycle repeats for 1 hr | |

Program 8—For Sleep Apnea Patients

| Voltage | Time (min) |
|---|---|
| 1.0-1.2 | 10 |
| 0.9 V | 5 |
| 0.8 V | 5 |
| Off | 10 |
| 0.8 | 10-20 seconds every 2-5 minutes |
| This cycle repeats for 2-3 hours | |

Clinical results indicating the effectiveness and health benefit of the present invention were obtained. In one trial, 68 COPD grade patients were tested. These patients used the device of the present invention three times per day, for 20 minutes, and for 10 days. The results were as follows:

1. 62 patients reduced their breathing rate from 18 to 14 breaths/minute.

2. 62 patients improved their blood pO2 from an average 92% to 97%.

3. 58 patients described their breathing as more comfortable.

18 patients received treatment with the device of the present invention for 2 weeks. Of those patients, 14 could walk without shortness of breath and 11 could reduce their medication needs after the 2 week course of treatment.

A small study with 3 patients suffering from sleep apnea was able to show that when the patients stopped breathing, activation of the device of the present invention (only for a few seconds) caused the patients to immediately start breathing. The sleep apnea patients could subsequently continue to sleep without any disruption.

In geriatric patients treated with the device of the present invention, muscle relaxation in regions of the legs, belly region and chest were clearly observed, as well as a more relaxed and slow breathing rhythm. This enabled the patients to feel better and allow physical movement Other applications of the present invention may include patients suffering from lung cancer, lung surgery, cystic fibrosis, ADHS, cardiac intervention or infarct or pneumonia or ALS patients. Obese people may also benefit from the present invention since they may have a limited lung volume due to greater adipose tissue around the lungs, which reduces the bronchioles, limits lung capacity and increases the breathing rate, leading to fess oxygen intake. In addition, people with insomnia who have been treated with the device of the present invention have reported significantly longer and better quality sleep and report feeling refreshed the following day.

Figure 9:
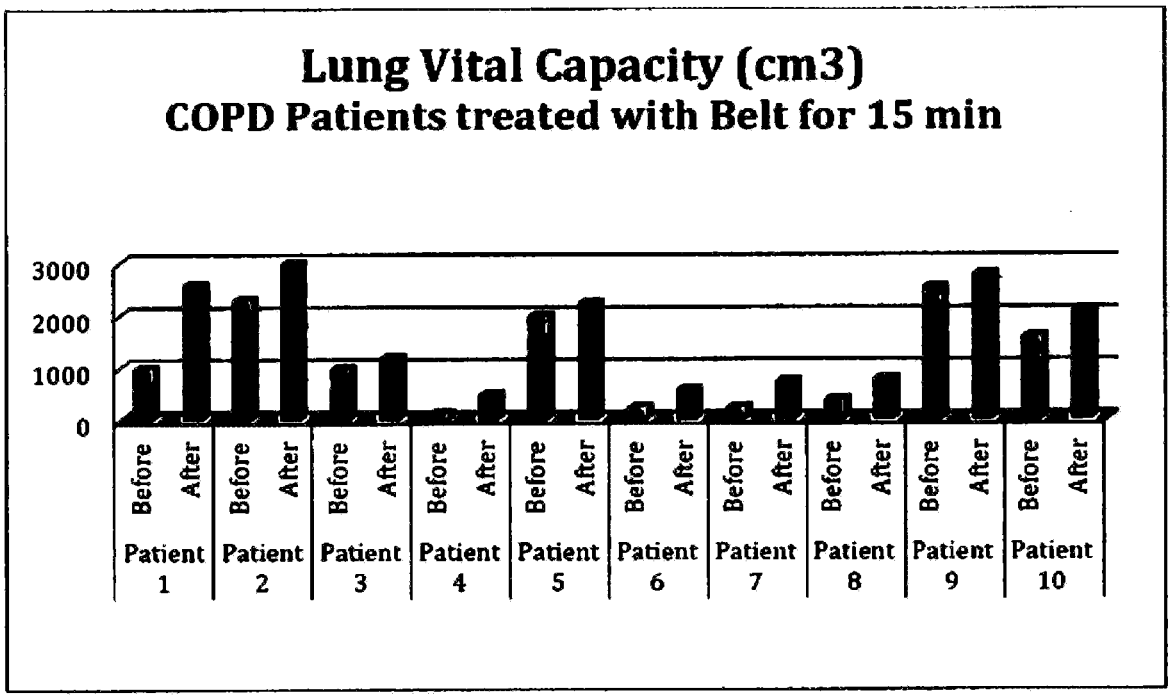
FIG. 9 is a chart illustrating increase in lung capacity after treatment of ten patients with COPD with the device of the present invention.

In yet another study, ten patients with COPD were treated with the device of the present invention for fifteen minutes. After a single use of the belt, the lung volume of all ten patients significantly increased as indicated in the chart shown in FIG. 9.

Another patient who used the belt of the present invention, a self-reported strong smoker, had consistent coughing and wheezing prior to using the belt. The patient reported a cessation of coughing and wheezing for three days after a single use of the belt for 15 minutes.

The device of the present invention may also be used for monitoring specific vital functions. A display of vital functions can be integrated via an appropriate interface. An embodiment of the device has at least one interface that supports the exchange of information. The information can be present in the form of physical units (e.g., as electrical voltage, current strength) or logical variables (data), whereas the exchange can be analog or digital. The interface includes data interfaces (interfaces for data transmission in general), general interfaces, machine interfaces (interfaces between physical systems), hardware interfaces (interfaces between physical systems of computer technology), network interfaces (interfaces between network components), software interfaces (interfaces between programs) and/or user interfaces (interfaces between man and machine). Preferred interfaces include radio or infrared interface or wired interfaces (for example USB). Using the interface, a secure and fast connection can be established and information exchanged. In addition, the device may be connected to other devices for monitoring vital functions, allowing a check of the safe and efficient operation of the device. It may also be preferred that the information (e.g. data) is saved on a storage medium or is transmitted from a computer based system—a transmitter—to the recipient via a network-based transmission or a long distance data transmission. The transmission medium is preferably the telephone network, radio or light, whereby a rapid and secure transfer of information is possible. Advantageously, the device itself has a memory that can store the data, such as duration of use and rotation speed selected. The device may transfer the data to an external storage medium. The data can be advantageously used for the analysis of the application, thereby allowing optimization of the application.

Figure 8B:
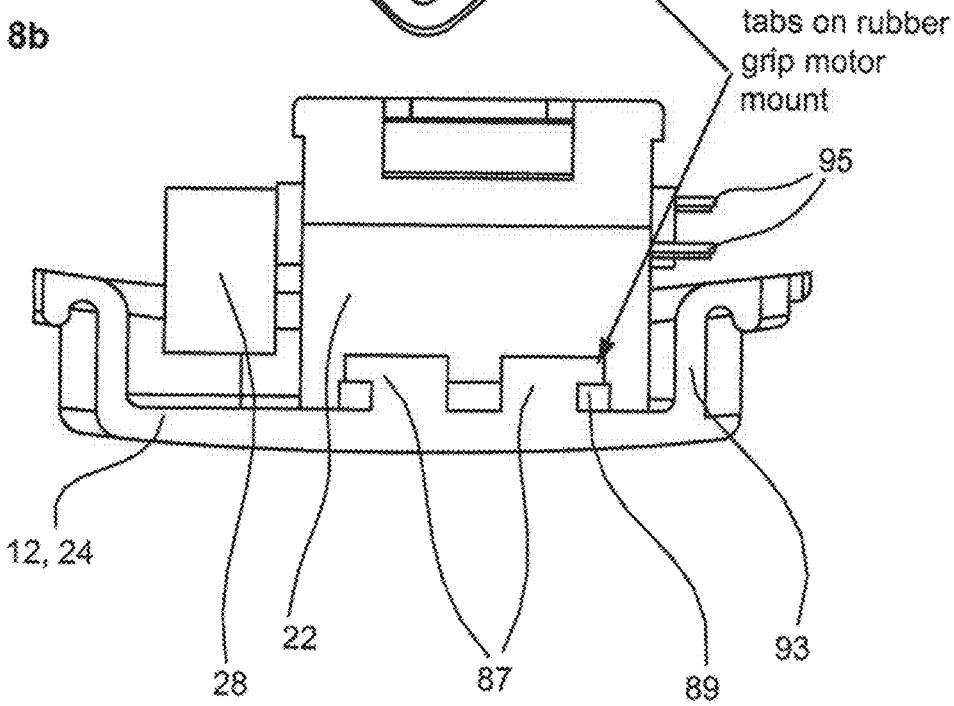
FIG. 8*b* illustrates a sectional side view of the vibration module 12 of FIG. 8*a*.

FIG. 8*a* illustrates a perspective back view of a vibration pad 12 (14, 16) without main casing 6 and back casing 26. FIG. 8*b* illustrates a sectional side view of the vibration pad 12 of FIG. 8*b*. The vibration pad incorporates damping features, such as a sponge, and isolates the vibration motor from main casing 6. The vibration pad 12 is designed to house the motor 20 and comprises a rectangular outer surrounding with rounded edges that is designed like a trough. On both sides of the vibration pad 12/24 flat side extensions are provided for mounting the vibration pad 12/24 to the strap 1 and the casing 6 as well as back casing 26 (compare FIG. 2). For this purpose the extensions comprise each two slits 91 and a hole (partly shown in FIG. 8*a*) that are designed complementary to the extensions of the back casing 26 as well as the mounting means of the main casing 6 for secure engagement when the vibration module 5, 7, 9 is assembled.

On the inner surface of the trough of the vibration pad 12/24 two tabs 87 are provided on both sides that extend approximately in parallel to one of the slits 91. The tabs 87 are provided for secure engagement of the motor housing 22 with the vibration pad 12/24. For this engagement the motor housing 22 comprises on both its lower end sides slits complementary to the tabs 87 for a snap fit connection when passing the tabs 87. Further, in some embodiments also suitable adhesives, e.g. silicone glue may be added on the mounting area to improve this connections. The motor housing 22 is further designed in a "u"-like shape, complementary to motor 20 for receiving and holding the motor 20. When the motor 20 is mounted via the motor housing 22 to the vibration pad 12/24 it is kept at a distance to the inner surface of the vibration pad 12/24 such that the flywheel 28 can move within the casing 6 and back casing 26 freely without any contact to the casing 6 and back casing 26 (compare FIG. 8*b*). Further, the motor 20 comprises two connectors 95 extending from the end of the motor 20 opposite to the flywheel 28 for electrical connection with the control panel 15 via wires (not shown). The vibration pad 12 provides beneficial features, such as transmitting the vibration effects in a more focused and efficient manner than plastic casing due to the elastic support or mount of the motor 20 within the elastic motor housing 22. The elastic support of the motor 20 and flywheel 28 with respect to the casing 6 and back casing 26 allows for directing most of the generated vibrations to the user thereby increasing the efficiency of the stimulation device.

Although preferred embodiments of the disclosure are illustrated and described in connection with particular features, it will be apparent to those skilled in the art of vibration treatments and respiratory therapies that the present invention, or variations thereof, can be adapted for use for a wide variety of treatments for individuals suffering from respiratory depression due to various causes. Various features of the disclosure have been particularly shown and described in connection with illustrated embodiments. However, it must be understood that the particular embodiments merely illustrate and that the invention is to be given its fullest interpretation within the terms of the claims.

The invention claimed is:

1. Stimulation device comprising:

a belt containing at least two vibration modules, wherein each of the at least two vibration modules comprises:

a pod with a casing, the casing defining an interior of the casing, and an elastic vibration pad arranged within the casing, the casing comprising a through-opening on a side of the casing, the vibration pad overlaying and covering the through-opening, and a central portion of the vibration pad protruding through the through-opening from the interior of the casing to outside of the casing, a vibration motor with a flywheel arranged within an elastic motor housing, the vibration motor and the elastic motor housing being disposed in the casing, the elastic motor housing being a generally U-shaped housing comprising a top wall connecting spaced apart first and second side walls, the top wall spaced from the vibration pad, the first and second side walls extending away from the top wall in a vertical direction towards the vibration pad to respective free end portions of the first and second side walls fastened to the vibration pad, the vibration motor being mounted to the vibration pad via the elastic motor housing, the vibration motor being disposed inside the elastic motor housing between the top wall of the motor housing and between the first and second side walls of the motor housing, the elastic motor housing being sufficiently rigid to hold the vibration motor spaced away from the vibration pad while resiliently supporting the vibration motor with respect to the vibration pad whereby vibrations generated by operation of the vibration motor are transmitted to the vibration pad through the first and second side walls;

and a control panel operating said vibration motors of the at least two vibration modules.

2. Stimulation device according to claim 1, wherein each of the at least two vibration modules comprises respective tab and slot connections fastening the first and second side walls of the elastic motor housing to the vibration pad.

3. Stimulation device according to claim 1, wherein each of the at least two vibration modules comprises the motor housing being mounted to the vibration pad via a snap-fit connection between the first and second side walls and the vibration pad.

4. Stimulation device according to claim 1, wherein each of the at least two vibration modules comprises the motor housing being at least partly designed in a complementary manner to an outer surface of the vibration motor for holding and supporting the vibration motor within the housing.

5. Stimulation device according to claim 1, wherein the belt comprises a strap having at least one belt fastening attachment.

6. Stimulation device according to claim 1, wherein each of the at least two vibration modules comprises the casing comprising a main casing and a back casing, the through-opening being disposed in the back casing wherein the vibration pad is arranged within the back casing and the motor housing isolates the vibration motor from the main casing.

7. Stimulation device according to claim 6, wherein the belt comprises a strap having at least one belt fastening attachment;

wherein each of the at least two vibration modules comprises the main casing and/or the back casing comprising at least one attachment means for engagement with and through the strap and engagement with the other of the back casing or main casing.

8. Stimulation device according to claim 1, wherein the control panel operates said vibration motors with an amplitude from between 0.3G to 1.0G and frequency ranging from between 16 Hz to 45 Hz complementary to a voltage of between 0.6V to 1.3V.

9. Stimulation device according to claim 8, wherein the control panel operates said vibration motors with an amplitude of between 0.3G and 0.62G, and a frequency of between 20 Hz and 37 Hz.

10. Stimulation device according to claim 1, wherein the elastic vibration pad of each of the at least two vibration modules comprises at least one of: silicone, rubber, TPE, TPU, or PVC.

11. Stimulation device according to claim 1, wherein at least one of the flywheels of the at least two vibration modules is dimensioned having a diameter of between 10 mm and 12 mm and a thickness of between 3.5 mm and 8 mm.

12. Stimulation device according to claim 1, wherein the at least one of the flywheels has a weight of 7-8 grams and/or is spaced 1-5 mm from the end of the motor.

13. Stimulation device according to claim 1, further comprising a display for displaying information related to vital functions, wherein the display of information is integrated via an interface and/or the interface supports the exchange of information with an external device.

14. Stimulation device according to claim 1, wherein the elastic motor housing is made of silicone.

15. Method for treating hypoventilation and respiratory depression of a human comprising the steps of:

(a) providing a stimulation device comprising:

a belt containing at least two vibration modules, wherein each of the at least two vibration modules comprises a pod with a casing, the casing defining an interior of the casing, an elastic vibration pad arranged within the casing, the casing comprising a through-opening on a side of the casing, the vibration pad overlaying and covering the through-opening, a central portion of the vibration pad protruding through the through-opening from the interior of the casing to outside of the casing, a vibration motor with a flywheel arranged within an elastic motor housing, the vibration motor and the elastic motor housing being disposed in the casing, the elastic motor housing being a generally U-shaped housing comprising a top wall connecting spaced apart first and second side walls, the top wall spaced from the vibration pad, the first and second side walls extending away from the top wall in a vertical direction towards the vibration pad to respective free end portions of the first and second side walls fastened to the vibration pad, the vibration motor being mounted to the vibration pad via the elastic motor housing, the vibration motor being disposed inside the elastic motor housing between the top wall of the motor housing and between the first and second side walls of the motor housing, the elastic motor housing being sufficiently rigid to hold the vibration motor spaced away from the vibration pad while resiliently supporting the vibration motor with respect to the vibration pad whereby vibrations generated by operation of the vibration motor are transmitted to the vibration pad through the first and second side walls;

and a control panel operating said vibration motors of the at least two vibration modules; and (b) using the stimulation device in treating hypoventilation and respiratory depression of the human.

16. Method of claim 15, the human having a thoracic diaphragm, wherein step (b) comprises the step of:

(c) fastening the belt of the stimulation device to the abdomen of the human and operating the belt, wherein the at least two vibration modules are externally applied to an abdominal region of the human and stimulate the human's diaphragm and thereby enhance the human's pulmonary function.

17. Method for reducing stress or anxiety of a human having a thoracic diaphragm, the method comprising the steps of:

(a) providing a stimulation device comprising:

a belt containing at least two vibration modules, wherein each of the at least two vibration modules comprises a pod with a casing, the casing defining an interior of the casing, an elastic vibration pad arranged within the casing, the casing comprising a through-opening on a side of the casing, the vibration pad overlaying and covering the through-opening, a central portion of the vibration pad protruding through the through-opening from the interior of the casing to outside of the casing, a vibration motor with a flywheel arranged within an elastic motor housing, the vibration motor and the elastic motor housing being disposed in the casing, the elastic motor housing being a generally U-shaped housing comprising a top wall connecting spaced apart first and second side walls, the top wall spaced from the vibration pad, the first and second side walls extending away from the top wall in a vertical direction towards the vibration pad to respective free end portions of the first and second side walls fastened to the vibration pad, the vibration motor being mounted to the vibration pad via the elastic motor housing, the vibration motor being disposed inside the elastic motor housing between the top wall of the motor housing and between the first and second side walls of the motor housing, the elastic motor housing being sufficiently rigid to hold the vibration motor spaced away from the vibration pad while resiliently supporting the vibration motor with respect to the vibration pad whereby vibrations generated by operation of the vibration motor are transmitted to the vibration pad through the first and second side walls;

and a control panel operating said vibration motors of the at least two vibration modules; and (b) fastening the belt of the stimulating device to the abdomen of the human and operating the belt, wherein the at least two vibration modules are externally applied to an abdominal region of the human and stimulate the human's diaphragm and thereby reduce the stress or anxiety of the human.

18. Method for facilitating the weaning of a human having a thoracic diaphragm from mechanical ventilation comprising the steps of:

(a) providing a stimulation device comprising:

a belt containing at least two vibration modules, wherein each of the at least two vibration modules comprises a pod with a casing, the casing defining an interior of the casing, an elastic vibration pad arranged within the casing, the casing comprising a through-opening on a side of the casing, the vibration pad overlaying and covering the through-opening, a central portion of the vibration pad protruding through the through-opening from the interior of the casing to outside of the casing, a vibration motor with a flywheel arranged within an elastic motor housing, the vibration motor and the elastic motor housing being disposed in the casing, the elastic motor housing being a generally U-shaped housing comprising a top wall connecting spaced apart first and second side walls, the top wall spaced from the vibration pad, the first and second side walls extending away from the top wall in a vertical direction towards the vibration pad to respective free end portions of the first and second side walls fastened to the vibration pad, the vibration motor being mounted to the vibration pad via the elastic motor housing, the vibration motor being disposed inside the elastic motor housing between the top wall of the motor housing and between the first and second side walls of the motor housing, the elastic motor housing being sufficiently rigid to hold the vibration motor spaced away from the vibration pad while resiliently supporting the vibration motor with respect to the vibration pad whereby vibrations generated by operation of the vibration motor are transmitted to the vibration pad through the first and second side walls;

and a control panel operating said vibration motors of the at least two vibration modules; and (b) fastening the belt of the stimulating device to the abdomen of the human and operating the belt, wherein the at least two vibration modules are externally applied to an abdominal region of the human and stimulate the human's diaphragm and thereby enhance the human's pulmonary function.

19. Method for improving the pulmonary function of a human having a thoracic diaphragm and suffering from COPD, the method comprising the steps of:

(a) providing a stimulation device comprising:

a belt containing at least two vibration modules, wherein each of the at least two vibration modules comprises a pod with a casing, the casing defining an interior of the casing, an elastic vibration pad arranged within the casing, the casing comprising a through-opening on a side of the casing, the vibration pad overlaying and covering the through-opening, and a central portion of the vibration pad protruding through the through-opening from the interior of the casing to outside of the casing, a vibration motor with a flywheel arranged within an elastic motor housing, the vibration motor and the elastic motor housing being disposed in the casing, the elastic motor housing being a generally U-shaped housing comprising a top wall connecting spaced apart first and second side walls, the top wall spaced from the vibration pad, the first and second side walls extending away from the top wall in a vertical direction towards the vibration pad to a respective free end portions of the first and second side walls fastened to the vibration pad, the vibration motor being mounted to the vibration pad via the elastic motor housing, the vibration motor being disposed inside the elastic motor housing between the top wall of the motor housing and between the first and second side walls of the motor housing, the elastic motor housing being sufficiently rigid to hold the vibration motor spaced away from the vibration pad while resiliently supporting the vibration motor with respect to the vibration pad whereby vibrations generated by operation of the vibration motor are transmitted to the vibration pad through the first and second side walls;

and a control panel operating said vibration motors of the at least two vibration modules; and (b) fastening the belt of the stimulating device to the abdomen of the human and operating the belt, wherein the at least two vibration modules are externally applied to an abdominal region of the human and stimulate the human's diaphragm and thereby enhance the human's pulmonary function.

20. Method for resuming the breathing of a human being having a thoracic diaphragm, the human being having stopped breathing as a result of a sleep apnea event, the method comprising the steps of:

(a) providing a stimulation device comprising:

a belt containing at least two vibration modules, wherein each of the at least two vibration modules comprises a pod with a casing, the casing defining an interior of the casing, an elastic vibration pad arranged within the casing, the casing comprising a through-opening on a side of the casing, the vibration pad overlaying and covering the through-opening, a central portion of the vibration pad protruding through the through-opening from the interior of the casing to outside of the casing, a vibration motor with a flywheel arranged within an elastic motor housing, the vibration motor and the elastic motor housing being disposed in the casing, the elastic motor housing being a generally U-shaped housing comprising a top wall connecting spaced apart first and second side walls, the top wall spaced from the vibration pad, the first and second side walls extending away from the top wall in a vertical direction towards the vibration pad to respective free end portions of the first and second side walls fastened to the vibration pad, the vibration motor being mounted to the vibration pad via the elastic motor housing, the vibration motor being disposed inside the elastic motor housing between the top wall of the motor housing and between the first and second side walls of the motor housing, the elastic motor housing being sufficiently rigid to hold the vibration motor spaced away from the vibration pad while resiliently supporting the vibration motor with respect to the vibration pad whereby vibrations generated by operation of the vibration motor are transmitted to the through the first and second side walls;

and a control panel operating said vibration motors of the at least two vibration modules;

(b) operating the stimulating device with the belt fastened to the abdomen of the human being who has stopped breathing wherein the at least two vibration modules are externally applied to an abdominal region of the human being and stimulate the human being's diaphragm and thereby cause the human being to resume breathing.

21. A method for improving the sleep quality of a human having a thoracic diaphragm, the method comprising the steps of:

(a) providing a stimulation device comprising:

a belt containing at least two vibration modules, wherein each of the at least two vibration modules comprises a pod with a casing, the casing defining an interior of the casing, an elastic vibration pad arranged within the casing, the casing comprising a through-opening on a side of the casing, the vibration pad overlaying and covering the through-opening, a central portion of the vibration pad protruding through the through-opening from the interior of the casing to outside of the casing, a vibration motor with a flywheel arranged within an elastic motor housing, the vibration motor and the elastic motor housing being disposed in the casing, the elastic motor housing being a generally U-shaped housing comprising a top wall connecting spaced apart first and second side walls, the top wall spaced from the vibration pad, the first and second side walls extending away from the top wall in a vertical direction towards the vibration pad to respective free end portions of the first and second side walls fastened to the vibration pad, the vibration motor being mounted to the vibration pad via the elastic motor housing, the vibration motor being disposed inside the elastic motor housing between the top wall of the motor housing and between the first and second side walls of the motor housing, the elastic motor housing being sufficiently rigid to hold the vibration motor spaced away from the vibration pad while resiliently supporting the vibration motor with respect to the vibration pad whereby vibrations generated by operation of the vibration motor are transmitted to the vibration pad through the first and second side walls;

and a control panel operating said vibration motors of the at least two vibration modules; and (b) fastening the belt of the stimulating device to the abdomen of the human and operating the belt, wherein the at least two vibration modules are externally applied to an abdominal region of the human and stimulate the human's diaphragm and thereby activate the human's parasympathetic nervous system for better quality of sleep.

* * * * *